US009145752B2

(12) United States Patent
Hendrie

(10) Patent No.: US 9,145,752 B2
(45) Date of Patent: Sep. 29, 2015

(54) CLAMPING ARRANGEMENT

(75) Inventor: Craig Hendrie, Aberdeen (GB)

(73) Assignee: Plexus Holdings, PLC., Aberdeen (GB)

( * ) Notice: Subject to any disclaimer, the term of this patent is extended or adjusted under 35 U.S.C. 154(b) by 312 days.

(21) Appl. No.: 13/581,247

(22) PCT Filed: Feb. 24, 2011

(86) PCT No.: PCT/GB2011/050367

§ 371 (c)(1),
(2), (4) Date: Sep. 24, 2012

(87) PCT Pub. No.: WO2011/104554

PCT Pub. Date: Sep. 1, 2011

(65) Prior Publication Data

US 2013/0008662 A1 Jan. 10, 2013

(30) Foreign Application Priority Data

Feb. 25, 2010 (GB) ..... 1003138.3

(51) Int. Cl.
*E21B 17/08* (2006.01)
*E21B 33/038* (2006.01)
(Continued)

(52) U.S. Cl.
CPC ..... *E21B 33/038* (2013.01); *E21B 17/04* (2013.01); *E21B 33/04* (2013.01)

(58) Field of Classification Search
CPC ..... E21B 17/04; E21B 33/038; E21B 33/04
USPC ..... 166/338, 339, 341, 343, 345, 348, 351, 166/360, 361, 365, 382, 85.1
See application file for complete search history.

(56) References Cited

U.S. PATENT DOCUMENTS 1,566,257 A 12/1925 Trout
4,919,454 A * 4/1990 Caulfield et al. ..... 285/18
(Continued)

FOREIGN PATENT DOCUMENTS

GB 2362906 A 12/2001

OTHER PUBLICATIONS

PCT International Search Report and Written Opinion of the International Searching Authority, Date Sep. 28, 2012, 14 pages,PCT/GB2011/050367, European Patent Office.
(Continued)

*Primary Examiner* — James G Sayre
(74) *Attorney, Agent, or Firm* — Egan, Peterman & Enders LLP.

(57) ABSTRACT

A mudline connector including a compression adaptor which can be elastically deformed onto an internal tubular member. The compression adaptor deflects inwardly to grip upper and lower sealing mandrels, providing axial and bending load support and creating a seal to isolate bore pressure from an outer annulus. The clamping arrangement provides a sealed connection between two well casing sections extending in opposite axial directions. The well casings are gripped and held in an end to end configuration by a radial load applied internally by a compression ring. The connector is activated by introducing pressure to activate pistons which in turn provide an axial thrust to stroke the internally tapered compression ring along the externally tapered compression collar, effectively creating an interference fit therebetween. This deflects the inner surface of the compression collar inwardly, deflecting the compression adaptor inwardly to grip the outer surfaces of the upper and lower sealing mandrels.

26 Claims, 4 Drawing Sheets

(51) Int. Cl.
*E21B 17/04* (2006.01)
*E21B 33/04* (2006.01)

(56) References Cited

U.S. PATENT DOCUMENTS 5,507,465 A * 4/1996 Borle ..... 251/1.2
5,671,812 A 9/1997 Bridges
7,111,688 B2 * 9/2006 vanBilderbeek ..... 166/382
7,686,087 B2 * 3/2010 Pallini et al. ..... 166/367
7,896,081 B2 * 3/2011 Pallini et al. ..... 166/345
7,997,345 B2 * 8/2011 Hannegan ..... 166/345
2004/0206509 A1 10/2004 Slack
2006/0196673 A1 9/2006 Pallini et al.
2007/0252387 A1 11/2007 Beard et al.
2013/0161021 A1 * 6/2013 Makosey et al. ..... 166/345

OTHER PUBLICATIONS

Search Report, Date of Search Apr. 8, 2010, 3 pages, GB1003138.3, United Kingdom Intellectual Property Office.

* cited by examiner

CLAMPING ARRANGEMENT

BACKGROUND OF THE INVENTION

The present application is the U.S. national-stage of PCT International Patent Application No. PCT/GB2011/050367, filed Feb. 24, 2011, which claims priority to Great Britain Patent Application No. 1003138.3, filed Feb. 25, 2010; the disclosure of each of which is specifically incorporated herein in its entirety by express reference thereto.

FIELD OF THE INVENTION

The present invention relates to a clamping arrangement for use in a mudline wellhead tieback system, a method of connecting a first part of a well casing to a second part of a well casing and a method of tying back to a mudline wellhead.

BACKGROUND OF THE INVENTION

A tieback system is a procedure for reconnecting a previously abandoned pre-production, exploration or appraisal well to a production platform or subsea christmas tree with the intention of producing hydrocarbons through it.

There are several advantages of using or being able to tieback to an existing well. For example, where an exploration well is drilled and finds a target that is particularly productive, it is possible to benefit from this prior work by tying back to an existing explorational well. This is particularly advantageous since it can save significant time and money rather than drilling another well with the purpose of production from the same field. A further advantage is that there are certain long lead times, such as incurred with the provision of a production platform or christmas trees etc, that are required to produce hydrocarbons. In addition, it is beneficial to drill production wells which can be temporarily abandoned during the time it takes to manufacture the platform etc. This then means that production can begin far sooner than it otherwise would have. Furthermore, at present certain wells, particularly in a high pressure/high temperature (HP/HT) environment cannot be tied back meaning that the well can only be drilled after the platform is in place.

In conventional tieback methods, a threaded connection is made between a well casing at the mudline and a well casing that extends towards the surface. The actuation of a threaded connection at this location can be restricted or even prohibited. In particular, within a HP/HT environment, nickel alloys are generally used within the well casings at this connection. However, nickel alloys have a strong tendency to scratch and gall one another under any sort of load. Accordingly, this present major problems when attempting to tie back within a HP/HT environment at the mudline.

It is an aim of the present invention to overcome at least one problem associated with the prior art whether referred to herein or otherwise.

SUMMARY OF THE INVENTION

According to a first aspect of the present invention there is provided a clamping arrangement for clamping a first tubular well casing and a second tubular well casing wherein the first tubular well casing and the second tubular well casing are axially aligned and extend in opposite directions, the arrangement comprising a collar having an externally tapered surface, the arrangement also including an annular component with an internally tapered surface, the collar and the annular component being relatively axially moveable between a first position in which the tapered surface of the annular component exerts no radial force on the collar and a second position which the tapered surface of the annular component exerts sufficient radial force to distort the collar inwardly to grip the first tubular well casing and the second tubular well casing.

Preferably the annular component comprises a compression ring.

Preferably the collar comprises a compression collar.

The compression collar may have an axially extending groove provided on the outer periphery and preferably the compression collar has a plurality of axially extending grooves provided radially around the outer periphery.

Preferably the first tubular well casing extends upwardly toward the surface of the sea.

Preferably the second tubular well casing extends downwardly towards a field and/or into the seabed.

Preferably the first tubular well casing is arranged, in use, to be clamped to the second tubular well casing in an end to end configuration.

Preferably the first tubular well casing abuts the end of the second tubular well casing.

Preferably the connector provides a sealed connector for connecting the flow of a fluid from the second tubular well casing to the first tubular well casing.

Preferably the arrangement includes a sleeve which is arranged, in use, to locate between an inner surface of the collar and outer surfaces of the first tubular well casing and the second tubular well casing.

Preferably the sleeve is arranged, in use, to be connected at an upper end to a surface casing which extends upwardly towards the sea surface.

Preferably the sleeve is arranged, in use, to be connected at a lower end to a surface casing which extends downwardly towards a field and preferably below the mudline.

Preferably the sleeve comprises a compression sleeve.

Preferably the first tubular well casing comprises an upper mandrel and more preferably comprises an upper sealing mandrel.

Preferably the second tubular well casing comprises a lower mandrel and more preferably comprises a lower sealing mandrel.

Preferably the upper mandrel is arranged, in use, to extend upwardly from the clamping arrangement towards the sea surface.

Preferably the lower mandrel is arranged, in use, to extend downwardly from the clamping arrangement below the mudline and/or away from the sea surface and/or towards a field.

The upper mandrel and an upper portion of the sleeve may define a first annular space therebetween.

The lower mandrel and a lower portion of the sleeve may define a second annular space therebetween.

The sleeve may comprise a passageway for enabling fluid flow from the first annular space to the second annular space. The passageway may comprise a passageway defined in the sleeve or a plurality of passageways defined in the sleeve.

Preferably the arrangement includes movement means for moving the annular component relative to the collar. Preferably the movement means comprises hydraulic movement means.

The movement means may comprise a chamber between the annular component and the upper clamping housing component, and the chamber may be pressurised to urge the annular component away from the upper clamping housing component. The clamping arrangement may comprise hydraulic fluid introduction means to introduce hydraulic fluid into the chamber in order to urge the annular component away from the upper clamping housing component.

The movement means may comprise a piston. Preferably the movement means comprises a plurality of pistons. Preferably the pistons are arranged radially around the annular component.

The or each piston may be mounted on a clamping housing and preferably on an upper clamping housing component. Preferably the upper clamping housing component is mounted to a lower end of a conductor which extends upwardly towards the sea surface. The or each piston may be arranged to extend downwardly from the clamping housing and to move the collar downwardly away from the clamping housing.

The sleeve is preferably a component which may be either threaded onto a casing or may be located in a suitable locating and receiving area on the casing.

The clamping arrangement preferably also provides a sealing function across the interface between the first tubular casing and the second tubular casing. The sealing function may be provided through a metal to metal contact between the outer periphery of the first tubular casing and/or the second tubular casing and the inner surface of the sleeve.

The clamping arrangement is especially suitable for clamping well casings (e.g. for oil or gas wells) to one another. The sleeve can be formed as part of a casing hanger used for supporting a casing in a well.

The clamping arrangement may comprise locking means to lock the annular component in the second position. The locking means may comprise a locking member which engages in a locking recess provided in a lower clamping housing component. Preferably the locking means comprises a plurality of locking members.

The locking member may comprise a locking finger.

The locking finger may comprise a resilient component that is inherently urged into engagement with the locking recess at the locking position or when the annular component reaches the second position.

The locking means may comprise lock release means. Preferably the lock release means is arranged to disengage the or each locking member from the locking recess.

The lock release means may comprise movement means to move the locking member out of engagement with the locking recess. The lock release means may comprise a piston and preferably comprises a hydraulic piston.

The clamping arrangement may comprise return movement means to move the annular component from the second position towards the first position. In particular, the return movement means may aid the release of the clamping force from between the annular component and the collar.

Preferably the return movement means comprises a chamber between the annular component and the lower clamping housing component, and the chamber may be pressurised to urge the annular component away from the lower clamping housing component.

The movement means may comprise a piston. Preferably the movement means comprises a plurality of pistons. Preferably the pistons are arranged radially around the annular component.

The or each piston may be mounted on a lower clamping housing component. Preferably the lower clamping housing component is mounted to an upper end of a conductor which extends downwardly away from the sea surface and/or below the mudline. The or each piston may be arranged to extend upwardly from the lower clamping housing component and to move the collar upwardly away from the lower clamping housing component.

Preferably the lower mandrel and/or upper mandrel have a roughened surface on their outer peripheries in order to increase the friction coefficient between the mandrel and the inner surface of the sleeve. Preferably the roughened surface consists of a plurality of sharp teeth in the form of a helical thread or a set of rings. Preferably the roughened surface is hardened by a process of nitriding.

Preferably the clamping arrangement comprises a mudline tieback connector.

Preferably the clamping arrangement comprises a subsea clamping arrangement.

Preferably the clamping arrangement comprises a high pressure/high temperature mudline tieback connector.

According to a second aspect of the present invention there is provided a well casing string including a clamping arrangement for clamping a first tubular well casing and a second tubular well casing wherein the first tubular well casing and the second tubular well casing are axially aligned and extend in opposite directions, the arrangement comprising a collar having an externally tapered surface, the arrangement also including an annular component with an internally tapered surface, the collar and the annular component being relatively axially moveable between a first position in which the tapered surface of the annular component exerts no radial force on the collar and a second position which the tapered surface of the annular component exerts sufficient radial force to distort the collar inwardly to grip the first tubular well casing and the second tubular well casing.

According to a third aspect of the present invention there is provided a method of clamping a first tubular well casing and a second tubular well casing within a clamping arrangement wherein the first tubular well casing and the second tubular well casing are axially aligned and extend in opposite directions, the method comprising moving a collar relative to an annular component wherein the collar has an externally tapered surface, and the annular component has an internally tapered surface, the method comprising moving the collar relative to the annular component between a first position in which the tapered surface of the annular component exerts no radial force on the collar and a second position which the tapered surface of the annular component exerts sufficient radial force to distort the collar inwardly to grip the first tubular well casing and the second tubular well casing.

Preferably the method comprises inwardly deflecting or distorting a compression adaptor on to the first tubular well casing and the second tubular well casing.

BRIEF DESCRIPTION OF THE DRAWINGS

The present invention will now be described by way of example only, with reference to the drawings that follow, in which.

DESCRIPTION OF THE PREFERRED EMBODIMENT

Figure 1:
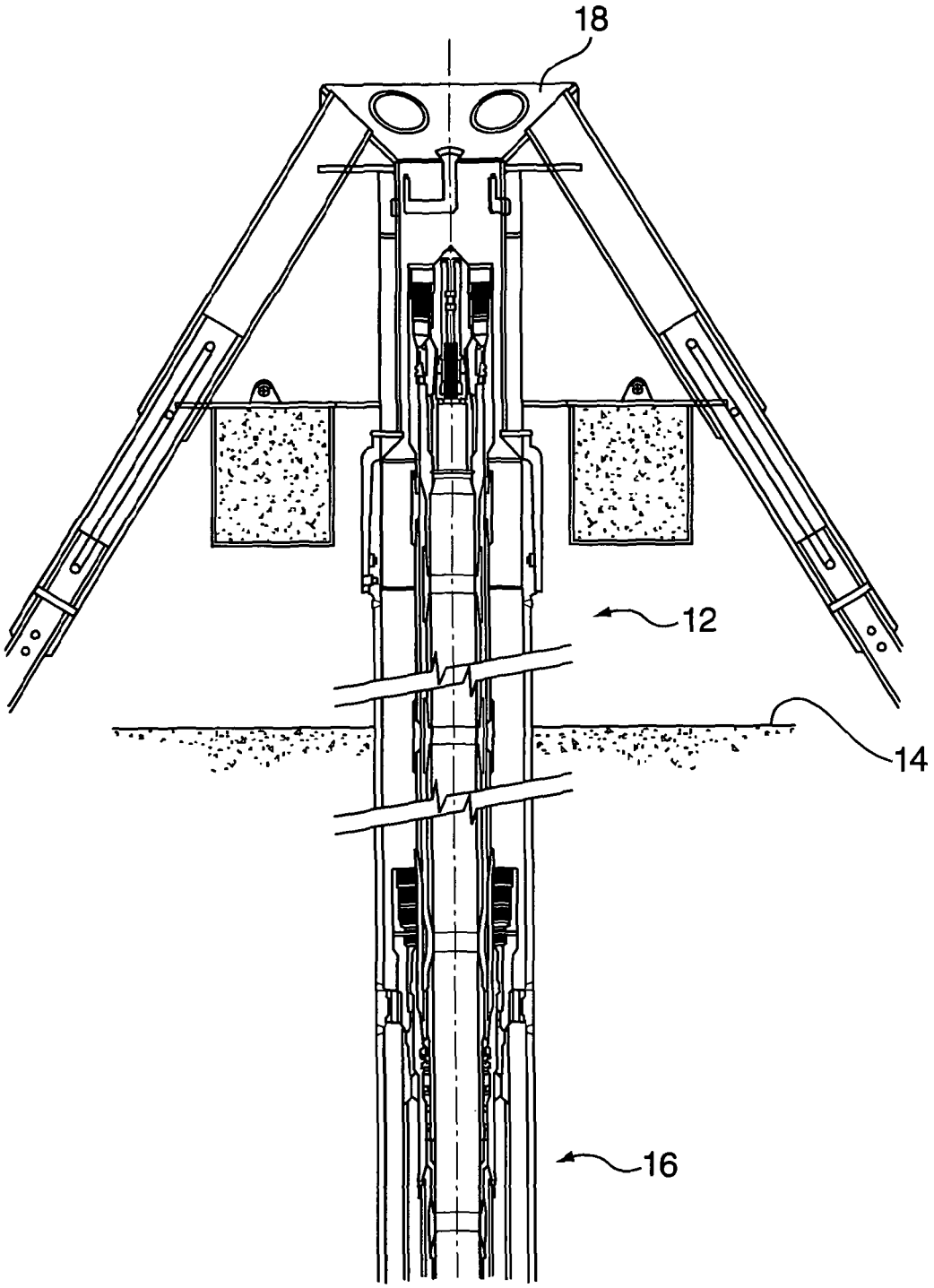
FIG. 1 is a cross section of an abandoned well at the mudline.

The present invention provides a subsea clamping arrangement 10 or subsea connector as a means of tying back to a pre-drilled well with the intention of benefitting from prior work for either production or further exploration purposes. The clamping arrangement 10 allows the tieback of the production casing without direct contact of the landing or tieback string to the mudline connections. This significantly reduces the risk of compromising the integrity of the subsequent tieback connection compared to conventional tieback methods. In particular, the present invention provides a clamping arrangement 10 or connector which will match or exceed the performance characteristics of the casing connections up and down the string.

The present invention provides a clamping arrangement comprising a high pressure/high temperature mudline tieback connector.

The present invention provides a clamping arrangement 10 or connector which works by elastically deforming a compression adapter 40 onto an internal tubular portion and specifically onto an upper sealing mandrel 50 and a lower sealing mandrel 56. This provides axial and bending load support and creates a seal to isolate the pressure in the bore 160 from the annular space 170 defined by concentric well casings and vice versa. The clamping arrangement 10 or connector does this by means of a radial load applied internally by a compression ring 60.

As shown in FIG. 1, an abandoned well 12 at the mudline 14 is provided with a protective structure 18 which protects and conceals the well whilst not being used. This abandoned well 12 includes a casing string 16 which extends downwardly into a field. The aim of the present invention is to provide an improved clamping and connecting arrangement for tying back this abandoned well to a production platform or subsea christmas tree. However, the preferred embodiment will be explained with reference to tying back to a production platform at the surface.

Figure 2:
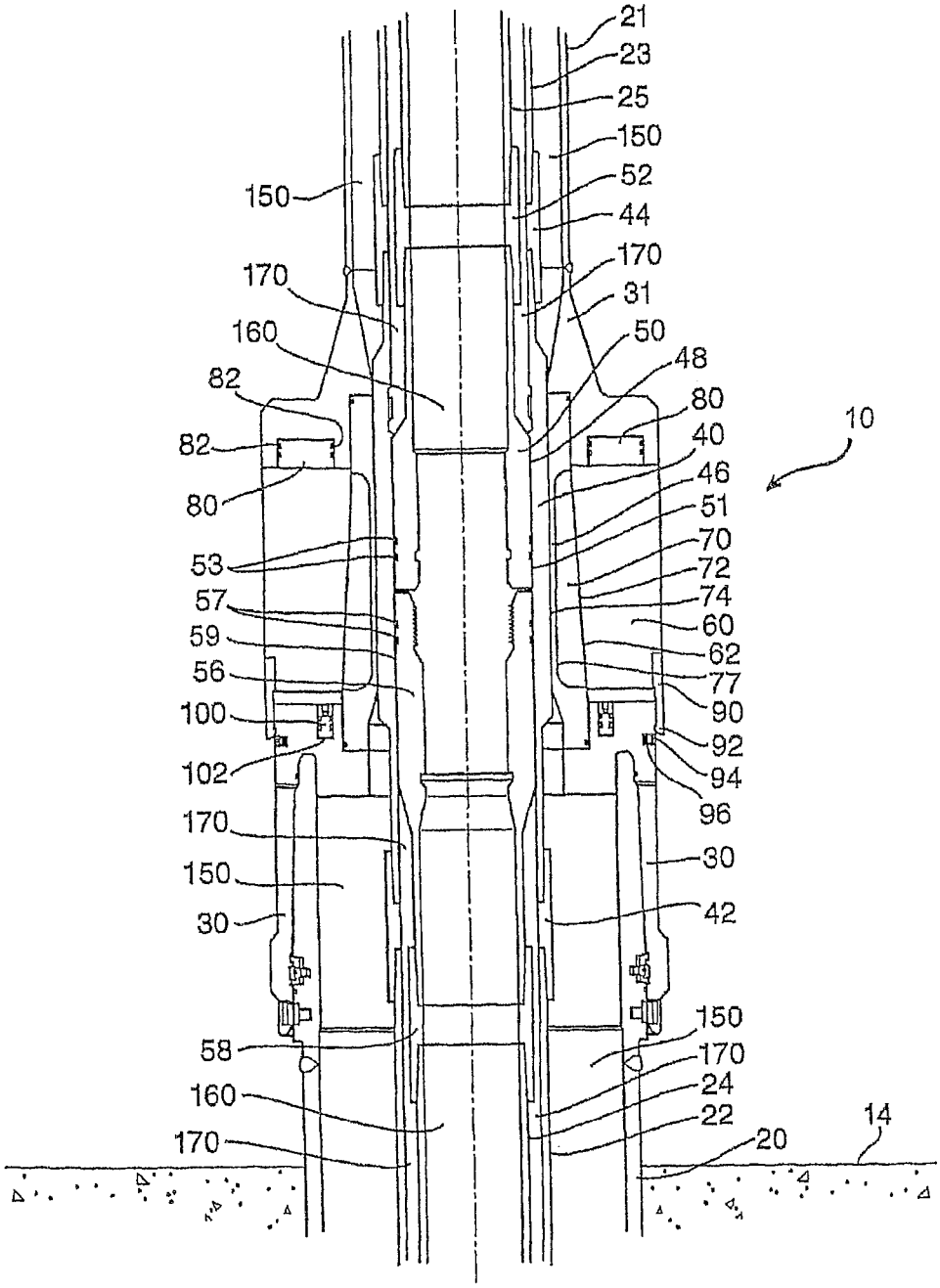
FIG. 2 is a cross sectional diagram of a preferred embodiment of a clamping arrangement for use in a mudline tieback system with the clamping arrangement in a pre-activated configuration.

As shown in FIG. 2, the casing string which extends downwardly towards a field comprises a lower conductor 20, a lower surface casing 22 and a lower production casing 24. In this preferred embodiment, the lower production casing 24 is located concentrically within a lower surface casing 22 which is located concentrically within a lower conductor 20 each of which extend downwardly below the mudline 14.

The present invention provides a connector to connect these lower casing portions 20, 22, 24 to respective upper casing portions 21, 23, 25. In particular, the lower conductor 20 is connected to an upper conductor 21, the lower surface casing 22 is connected to an upper surface casing 23 and the lower production casing is connected to an upper production casing 25.

The clamping arrangement 10 includes a lower clamping housing component 30 and an upper clamping housing component 31. The lower clamping housing component 30 is mounted to the upper end of the lower conductor 20. In use, the upper conductor 21 is secured to the upper clamping housing component 31. Accordingly, the conductor is connected through the clamping housing components 30, 31.

The aim of the present invention is to provide a tieback system which provides a production casing which extends from the mudline to the production platform.

The clamping arrangement 10 provides an upper sealing mandrel 50 which is connected by a connector 52 to the upper production casing 25 which extends upwardly towards the production platform. The clamping arrangement 10 includes a lower sealing mandrel 56 which is connected by a connector 58 to the lower production casing 24 which extends downwardly towards the field.

The upper sealing mandrel 50 includes an upper sleeve portion and a lower sleeve portion having an increased wall thickness. The upper sleeve portion includes connection means to connect the upper sealing mandrel 50 to a connector 52.

The lower sleeve portion including the increased wall thickness (or reinforced wall) is arranged, in use to be gripped and urged inwardly towards the bore of the production casing. The outer surface of the lower sleeve portion includes sealing means to increase the seal formed between the upper sealing mandrel 50 and the compression adaptor 40. In the preferred embodiment, the sealing means comprises two spaced apart annular sealing members 53.

The lower sealing mandrel 56 includes a lower sleeve portion and an upper sleeve portion having an increased wall thickness. The lower sleeve portion includes connection means to connect the lower sealing mandrel 56 to a connector 58. The upper sleeve portion including the increased wall thickness (or reinforced wall) is arranged, in use to be gripped and urged inwardly towards the bore of the production casing. The outer surface of the upper sleeve portion includes sealing means to increase the seal formed between the lower sealing mandrel 56 and the compression adaptor 40. In the preferred embodiment, the sealing means comprises two spaced apart annular sealing members 57.

The lower sealing mandrel 56 and the upper sealing mandrel 50 have a roughened surface on their outer peripheries in order to increase the friction coefficient between the respective mandrel 50, 56 and the inner surface 46 of the compression adaptor (sleeve) 40. The roughened surfaces consist of a plurality of sharp teeth and/or hardened teeth in the form of a helical thread or a set of rings. The roughened surfaces are hardened by a process of nitriding. For example, the roughened surfaces may be provided on the upper portion of the lower sealing mandrel 56 and the lower portion of the upper sealing mandrel 50. These portion are the areas that will be gripped and squeezed by the inward deflection of the compression adaptor.

The aim of the present invention is to provide a sealed connection between the upper production casing 25 and the lower production casing 24. This is achieved by providing a sealing tied connection between the lower sealing mandrel 56 and the upper sealing mandrel 50.

The upper string extending from the mudline connection towards the surface production platform comprises a production casing 25 located concentrically within a surface casing 23 which is located concentrically within a conductor 21. Accordingly, the upper string replicates the lower string.

The completed string essentially comprises a conductor 20, 21 which defines an annular space 150 with the concentrically arranged surface casing 22, 23. Similarly, the surface casing 22, 23 defines an annular space 170 with the concentrically arranged production casing 24, 25. This annular space 170 is partitioned from the bore 160 within the production casing 24, 25 and the connector 10 retains the integrity of this partition.

In addition, the connector 10 also retains the continuity of the annular space 170 defined between the surface casing 22, 23 and the production casing 24, 25 by providing a fluid passageway through the compression adaptor 40. In particular, the wall of the compression adaptor 40 includes at least one fluid passageway which extends from a lower position where the passageway is in communication with the annular space 170 in the lower string to an upper position where the passageway is in communication with the annular space 170 in the upper string.

The present invention provides a clamping arrangement for sealingly clamping the lower production casing 24 to the upper production casing 25. In particular, the present invention provides a fluid tight seal between the lower sealing mandrel 56 and the upper sealing mandrel 50 both of which are secured to the ends of the respective upper and lower production casings 24, 25.

The clamping arrangement 10 or connector comprises a sleeve in the form of a compression adapter 40 which locates around the outer peripheries of the upper sealing mandrel 50 and the lower sealing mandrel 56. The compression adapter 40 is connected at a lower end through a connector 42 to the lower surface casing 22. Similarly, the compression adapter 40 is connected at its upper end through a connector 44 to the upper surface casing 23. The compression adapter 40 is a continuous tubular member in which the inner periphery is arranged to encompass the outer peripheries of the upper sealing mandrel 50 and the lower sealing mandrel 56. The outer surface 46 of the compression adapter 40 is located within a collar 70 and in particular a compression collar 70.

The compression collar 70 includes an outwardly tapered surface 72 and, in particular, comprises a surface 72 which is tapered outwardly from an upper location to a lower location.

The compression collar 70 may have axially extending grooves 77 provided radially around the outer periphery. This effectively allows a greater diameter compression collar 70 to be used because the grooves reduce the stiffness of the compression collar thereby requiring less compression load.

The clamping arrangement 10 or connector includes a compression ring 60 which locates around the outer surface 72 of the compression collar 70. The compression ring 60 includes an inwardly tapered surface 62 and, in particular, includes an inner periphery 62 which is tapered outwardly from an upper location to a lower location. The inner tapered surface 62 is arranged to register and cooperate with the tapered surface 72 provided on the compression collar 70.

The connector 10 includes movement means or activation means in the form of an activation piston 80 or a plurality of activation pistons 80 which locate at the upper end of the compression ring 60. The activation pistons 80 are mounted on the upper clamping housing component 31 which locates at the top of the connector 10 and provides a wall which extends upwardly and connects to the conductor 21 which extends upwardly towards the sea surface.

The activation piston 80 includes a piston port through which a pressurised fluid may be introduced into a chamber 81 order to cause the activation piston 80 to extend downwardly. The movement downwardly of the piston 80 causes the compression ring 60 to move downwardly. During this movement, the tapered surface 62 of the compression ring 60 abuts the tapered surface 72 of the compression collar 70. The co-operation of these tapered surfaces 62, 72 causes the force generated within the piston(s) 80 to be transferred to a radial force which urges the inner surface 74 compression collar 70 inwardly which thereby forces the compression adapter 40 inwardly. The movement of the compression adapter 40 inwardly causes the inner surface 48 of the compression adapter 40 to grip and abut the outer surfaces 51, 59 of the lower sealing mandrel 56 and the upper sealing mandrel 50. In particular, the force is sufficient for the lower sealing mandrel 56 and the upper sealing mandrel 50 to be firmly gripped by the compression adapter 40.

The wall of the compression adaptor 40 is sufficiently thin to allow the wall to be distorted inwards to grip the smaller diameter upper sealing mandrel 50 and lower sealing mandrel 56.

The compression ring 60 and the compression collar 70 have oppositely directed axially tapered annular surfaces so that relative axial movement between the compression collar 70 and the compression ring 60 produces a reduction in the internal diameter of the unit (in particular the internal diameter of the compression collar 70) to distort the compression adaptor 40 inwards to grip the smaller diameter upper and lower sealing mandrels 50, 56. The oppositely tapered annular surfaces are angled to provide the required inwards movement (compression/distortion) whilst enabling the movement means to produce the relative movement between the compression ring 60 and the compression collar 70.

It is appreciated that the amount of travel of the compression ring 60 to the activated/locked position together with the angles of the tapers will determine the amount of inward deflection caused by the clamping arrangement 10 and hence the gripping force.

The compression ring 60 and the compression collar 70 each have one tapered annular surface. In the assembled unit, in use, the compression collar 70 has an outer diameter with a first diameter at an upper end and an outer diameter with a second, greater diameter at a lower end. Similarly, in the assembled unit, the compression ring 60 has an inner diameter with a first diameter at an upper end and an inner diameter with a second, greater diameter at a lower end.

The compression collar 70 is a tubular sleeve member in which the wall thickness increases from the upper end to the lower end in order to provide the outer tapered surface. The inner surface of the compression collar 70 provides a passageway of a constant diameter which is arranged to be deflected inwardly to provide a passageway of a reduced diameter.

Figure 3:
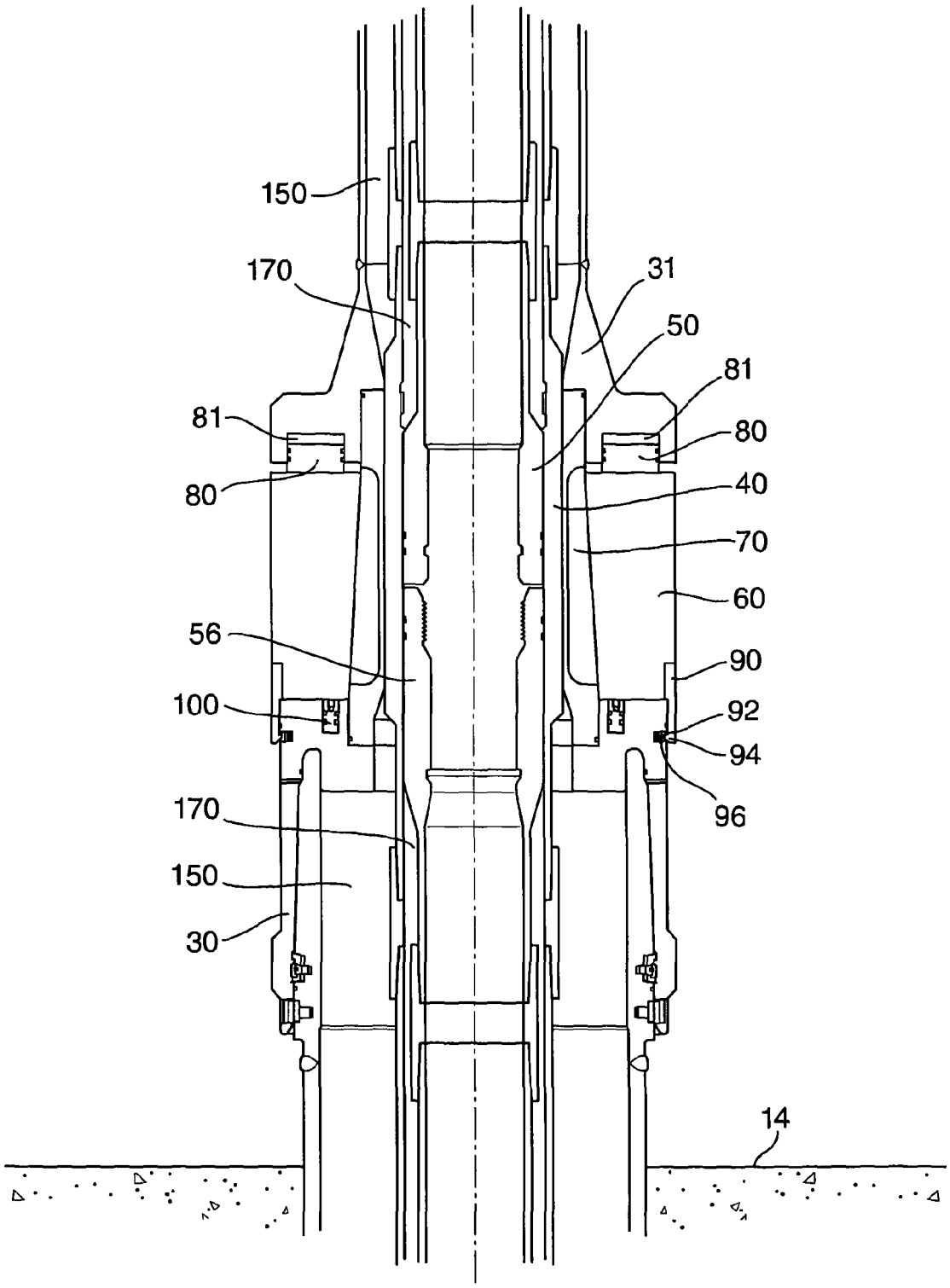
FIG. 3 is a cross sectional diagram of a preferred embodiment of a clamping arrangement for use in a mudline tieback system with the clamping arrangement in an activated configuration.
Figure 4:
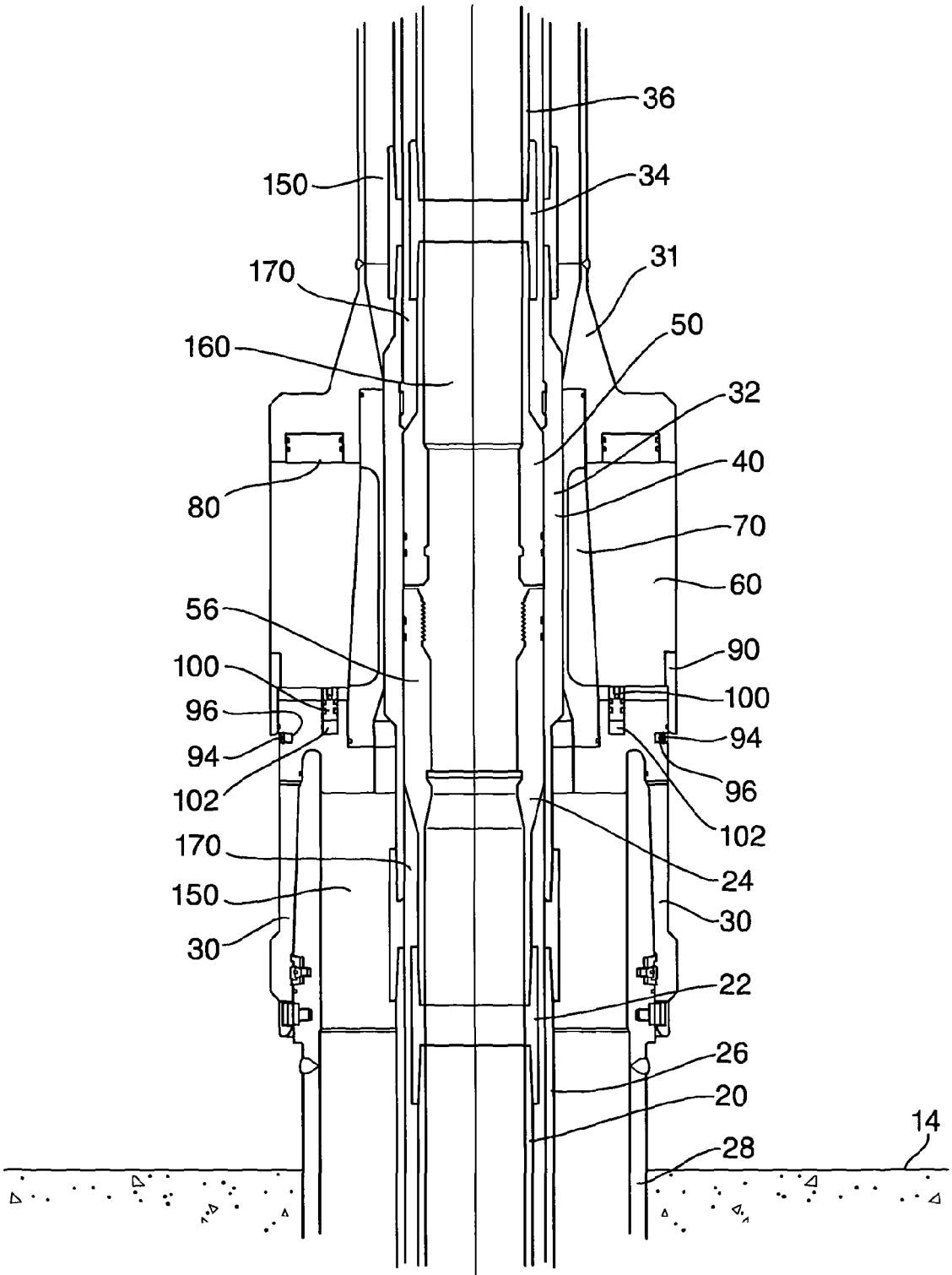
FIG. 4 is a cross sectional diagram of a preferred embodiment of a clamping arrangement for use in a mudline tieback system with the clamping arrangement in a released configuration.

Similarly, the compression ring 60 is a tubular (annular) sleeve member in which the wall thickness decreases from the upper end to the lower end in order to provide the inner tapered surface. The outer surface of the compression ring 60 provides an outer surface of a constant diameter. As shown in FIG. 2, FIG. 3 and FIG. 4 the wall thickness of the compression ring 60 is significantly greater than the wall thickness of the compression collar 70. In addition, the compressibility of the compression collar 70 is increased through the provision of axially extending slots 77 located around the outer surface of the compression collar 70.

The clamping arrangement 10 is arranged to deflect the inner surface of the compression adaptor 40 such that the inner surface of the adaptor 40 simultaneously grips the outer surface of the upper sealing mandrel 50 and the outer surface of the lower sealing mandrel 56. Accordingly, the location of greatest inward deflection is arranged to locate at the end to end abutment location of the upper and lower sealing mandrels 50, 56. This ensures that both sealing mandrels 50, 56 are sufficiently gripped. The outer surfaces of the sealing mandrels 50, 56 have identical diameters to ensure both are gripped with equal and sufficient force and the force is transferred evenly.

The piston 80 may be formed by an annular member 80 upstanding from the upper surface of the compression ring 60. The annular member may sealing engage in an annular chamber 81 provided on a lower surface of the upper clamping housing component 31. The annular member 80 includes sealing members 82 extending on inner and outer surfaces to provide a sealed chamber 81 such that hydraulic fluid may be introduced into the chamber 81 in order to force and urge and move the compression ring downwardly relative to the upper clamping housing component 31.

The compression ring 60 includes a plurality of locking members 90 in the form of locking fingers 90 located around the periphery thereof. Each locking finger 90 extends downwardly from the bottom of the compression ring 60. The locking finger 90 includes an inwardly projecting portion 92 which is arranged to engage within a locking recess 94 provided in the lower clamping housing component 30.

As the compression ring 60 moves downwardly the locking portions 92 on the locking fingers 90 also move downwardly until they are engaged within the corresponding locking recesses 94. At this position, the compression ring 60 is locked in position and the lower sealing mandrel 56 and the upper sealing 50 are gripped and are thereby connected in an end to end configuration by the clamping arrangement 10. At this stage, the activation piston(s) 80 may be deactivated such that the locking fingers 90 retain the compression ring 60 in the locked position. FIG. 3 shows the clamping arrangement in the activated position.

The clamping arrangement 10 or connector includes release means in order to release the locking fingers 90 from the locked position. In particular, the release means includes locking finger release pistons 96 which are activated through a locking finger release port. In particular, hydraulic fluid is introduced into the locking finger release port which thereby moves the locking finger release pistons 96 outwardly which abut and move the locking elements 92 out of the locking recesses 94 within the lower clamping housing component 30. Once located out of the locking recesses 94, the locking fingers 90 are free to move upwardly. The release means may include release movement pistons 100 which move the compression ring 60 upwardly in order to release the force on the compression collar 70.

The release movement piston(s) 100 are mounted on the lower surface of the compression ring and may be similar in configuration to the movement piston(s) 80. The release movement piston(s) 100 includes a chamber 102 in which the release movement piston(s) 100 locates. A hydraulic fluid can be introduced into the chamber 102 to urge and force the piston out of the chamber 102 which thereby causes the compression ring 60 to move upwardly. This causes the inner tapered surface 62 of the compression ring 60 to move upwardly relative to the outer tapered surface 72 of the compression collar 70. This then releases the inwardly directed pressure on the outer surface 46 of the compression adaptor 40 and thereby releases the gripping force between the inner surface 45 of the compression adaptor 40 and the outer surfaces 51, 59 of the upper and lower sealing mandrels 50, 56.

This thereby releases the pressure on the compression adapter 40 such that the upper sealing mandrel 50 and the lower sealing mandrel 56 are no longer gripped by the clamping arrangement 10. FIG. 4 shows the clamping arrangement in the released position.

As can be seen, the present invention provides a simple locking mechanism which is particularly suited to a mudline tieback system. The complete production system may include clamping arrangements for the casings at the surface and the present invention provides a gripping system such that the correct and sufficient tension may be introduced into the production casing at the surface such that the production casing 25 is at the required tension between the production platform and the mudline tieback apparatus. The clamping arrangement 10 may be remotely activated.

In summary, the mudline connector 10 works by elastically deforming the compression adaptor 40 onto an internal tubular member—in this case the upper & lower sealing mandrels 50, 56—in order to provide axial & bending load support and create a seal to isolate bore 160 pressure from the annulus 170 and vice-versa. The connector 10 does this by means of a radial load applied internally by the compression ring 60.

The connector 10 is activated by introducing pressure into the piston port activation thus stroking the activation piston(s) 80 which in turn provides an axial thrust to stroke the internally tapered compression ring 60 along the externally tapered compression collar 70 effectively creating an interference fit therebetween. It is this interference fit that creates the subsequent radial load to create the necessary contact between the compression adaptor 40 and the upper sealing mandrel 50 and the lower sealing mandrel 56. Once in the fully set position, the locking finger(s) 90 which work like radial springs find their locking position in the housing 30 and lock-down the compression ring 60 in the 'set' position. The pressure in the piston chamber 81 can then be released.

The contact load can be varied depending on the application by changing the activation load, geometry of the load bearing components, calculated interference etc.

The connector 10 can be released by firstly introducing pressure into the locking finger release piston port 96 to stroke the locking finger release piston 94, this will provide a radial thrust pushing the locking finger 90 out of it's locking position in the housing 30—at this point there is no mechanical lock holding the connector 10 in the 'set' position. Pressure can then be introduced into the piston port(s) and into the piston release chamber 102 for urging the pistons 100 which provides an axial thrust to stroke the compression ring 60 back to its 'unset' position. The pressure in the locking finger release port/chamber 96 and in the piston release chamber 102 can then be released at this point.

Because the system is designed so that all components elastically deform only, the connector can be activated and deactivated numerous times without degradation of the connector or compromise of the tie-back integrity.

The invention claimed is:

1. A clamping arrangement for clamping a first tubular well casing and a second tubular well casing wherein the first tubular well casing and the second tubular well casing are axially aligned and extend in opposite directions such that an end of the first well casing abuts an end of the second well casing, the arrangement comprising:

a collar having an internal surface and an externally tapered surface;

an annular component with an internally tapered surface arranged to cooperate with the tapered surface of the collar; and a continuous tubular member having an internal surface and an external surface, and the tubular member being located between the collar and the first and second tubular well casings, such that the internal surface of the tubular member contacts an external surface of both of the first and second well casings, wherein the collar and the annular component are relatively axially moveable between a first position in which the tapered surface of the annular component exerts no radial force on the collar and a second position in which the tapered surface of the annular component exerts sufficient radial force to urge the collar inwardly so as to elastically deform the tubular member such that the internal surface of the tubular member simultaneously grips and abuts the external surfaces of both the first tubular well casing and the second tubular well casing so as to form a seal between the tubular member and the first well casing and a seal between the tubular member and the second well casing.

2. A clamping arrangement as claimed in claim 1 in which the annular component comprises a compression ring.

3. A clamping arrangement as claimed in claim 1 or claim 2 in which the collar comprises a compression collar.

4. A clamping arrangement as claimed in claim 1 in which the clamping arrangement provides a sealed connector for connecting the flow of a fluid from the second tubular well casing to the first tubular well casing.

5. A clamping arrangement as claimed in claim 1 in which the sleeve comprises a compression sleeve.

6. A clamping arrangement as claimed in claim 1 in which the first tubular well casing comprises an upper mandrel.

7. A clamping arrangement as claimed in claim 6 in which the second tubular well casing comprises a lower mandrel.

8. A clamping arrangement as claimed in claim 7 in which the upper mandrel and an upper portion of the sleeve define a first annular space therebetween.

9. A clamping arrangement as claimed in claim 8 in which the lower mandrel and a lower portion of the sleeve define a second annular space therebetween.

10. A clamping arrangement as claimed in claim 9 in which the sleeve comprise a passageway for enabling fluid flow from the first annular space to the second annular space.

11. A clamping arrangement as claimed in claim 7 in which the lower mandrel and/or upper mandrel have a roughened surface on their outer peripheries in order to increase the friction coefficient between the mandrel and the inner surface of the sleeve.

12. A clamping arrangement according to claim 11 in which the roughened surface consists of a plurality of sharp teeth in the form of a helical thread or a set of rings.

13. A clamping arrangement as claimed in claim 1 in which the arrangement includes movement means for moving the annular component relative to the collar.

14. A clamping arrangement as claimed in claim 13 in which the movement means comprises hydraulic movement means.

15. A clamping arrangement as claimed in claim 1, further comprising a chamber defined between the annular component and an upper clamping housing component, where the chamber is able to be pressurised in order to urge the annular component away from the upper clamping housing component.

16. A clamping arrangement as claimed in claim 1 in which the clamping arrangement also provides a sealing function across the interface between the first tubular casing and the second tubular casing.

17. A clamping arrangement according to claim 16 in which the sealing function is provided through a metal to metal contact between the outer peripheries of the first tubular well casing and the second tubular well casing and the inner surface of the sleeve.

18. A clamping arrangement as claimed in claim 1 in which the clamping arrangement comprises locking means to lock the annular component in the second position.

19. A clamping arrangement according to claim 18 in which the locking means comprises lock release means.

20. A clamping arrangement according to claim 1, further comprising a locking member which engages in a locking recess provided in a lower clamping housing component to lock the annular component in the second position.

21. A clamping arrangement as claimed in claim 1 in which the clamping arrangement comprises return movement means to move the annular component from the second position towards the first position.

22. A clamping arrangement according to claim 21 in which the return movement means aids the release of the clamping force from between the annular component and the collar.

23. A clamping arrangement as claimed in claim 1, wherein in the first position the tapered surface of the annular component exerts no radial force on the collar.

24. A well casing string including a clamping arrangement for clamping a first tubular well casing and a second tubular well casing wherein the first tubular well casing and the second tubular well casing are axially aligned and extend in opposite directions in an end-to-end configuration, the arrangement comprising a collar having an internal surface and an externally tapered surface, the arrangement also including an annular component with an internally tapered surface, and a sleeve having an internal surface and an external surface, the sleeve being located between the internal surface of the collar and the external surfaces of the first and second tubular well casings, and the collar and the annular component being relatively axially moveable between a first position in which the tapered surface of the annular component exerts no radial force on the collar and a second position in which the tapered surface of the annular component exerts sufficient radial force to urge the collar inwardly so as to distort the sleeve such that the internal surface of the sleeve grips and abuts the external surfaces of both the first tubular well casing and the second tubular well casing.

25. A method of clamping a first tubular well casing and a second tubular well casing within a clamping arrangement wherein the first tubular well casing and the second tubular well casing are axially aligned and extend in opposite directions in an end-to-end configuration, the method comprising:

locating a sleeve between external surfaces of the first and second tubular well casings and an internal surface of a collar, the collar having an internal surface and an externally tapered surface, moving the collar relative to an annular component, the annular component having an internally tapered surface; and moving the collar relative to the annular component between a first position in which the tapered surface of the annular component exerts no radial force on the collar and a second position in which the tapered surface of the annular component exerts sufficient radial force to urge the collar inwardly so as to distort the sleeve such that the internal surface of the sleeve grips and abuts the external surfaces of both the first tubular well casing and the second tubular well casing.

26. A clamping arrangement for clamping a first tubular well casing and a second tubular well casing wherein the first tubular well casing and the second tubular well casing are axially aligned and extend in opposite directions in an end-to-end configuration, the arrangement comprising:

a collar having an internal surface and an externally tapered surface;

an annular component with an internally tapered surface; and a sleeve having an internal surface and an external surface, and the sleeve being located between the internal surface of the collar and external surfaces of the first and second tubular well casings, wherein the collar and the annular component are relatively axially moveable between a first position in which the tapered surface of the annular component exerts no radial force on the collar and a second position in which the tapered surface of the annular component exerts sufficient radial force to urge the collar inwardly so as to distort the sleeve such that the internal surface of the sleeve grips and abuts the external surfaces of both the first tubular well casing and the second tubular well casing.

* * * * *